US006006548A

United States Patent [19]

Freilich

[11] Patent Number: 6,006,548

[45] **Date of Patent: *Dec. 28, 1999**

[54] FACET CUT STRUCTURE FOR GEMSTONES TO ENHANCE BRILLIANCE

[75] Inventor: Joseph Freilich, Old Westbury, N.Y.

[73] Assignee: M. Fabrikant & Sons, Ltd., New York, N.Y.

[ * ] Notice: This patent is subject to a terminal disclaimer.

[21] Appl. No.: 09/093,745

[22] Filed: Jun. 8, 1998

Related U.S. Application Data

[63] Continuation-in-part of application No. 08/712,812, Sep. 12, 1996, Pat. No. 5,761,929, which is a continuation-in-part of application No. 29/079,887, Nov. 25, 1997, Pat. No. Des. 403,979.

[51] Int. Cl.[6] ..... A44C 17/00

[52] U.S. Cl. ..... 63/32; D11/89; D11/90

[58] Field of Search ..... 63/32; D11/89, D11/90

[56] References Cited

U.S. PATENT DOCUMENTS

| | | | |
|---|---|---|---|
| D. 45,668 | 4/1914 | Heller | D11/90 |
| D. 46,735 | 12/1914 | Heller | D11/90 |
| D. 48,644 | 2/1916 | Miller | D11/90 |
| D. 58,317 | 7/1921 | Heller | D11/90 |
| D. 85,505 | 11/1931 | Zell | D11/90 |
| 223,237 | 1/1880 | Meyer | D11/90 |
| D. 360,376 | 7/1995 | Kaplan | D11/90 |
| D. 365,780 | 1/1996 | Kaplan | D11/90 |
| D. 373,551 | 9/1996 | Udko | D11/90 |
| D. 403,979 | 1/1999 | Freilich | D11/90 |
| D. 411,479 | 6/1999 | Yerushalmi et al. | D11/90 |
| 2,009,390 | 7/1935 | Bayardi | 63/32 |
| 5,186,024 | 2/1993 | Waters, Jr. | 63/32 |
| 5,761,929 | 6/1998 | Freilich | 63/32 |

*Primary Examiner*—Terry Lee Melius
*Assistant Examiner*—Andrea Chop
*Attorney, Agent, or Firm*—Levisohn, Lerner, Berger & Langsam

[57] ABSTRACT

A new structure for a colored gem, generally round or oval, in which a barrel cut is employed, but which has a center top edge and transverse boundaries which increases the thickness of the stone with additional facets provided to enhance reflection and overall brilliance.

17 Claims, 8 Drawing Sheets

FACET CUT STRUCTURE FOR GEMSTONES TO ENHANCE BRILLIANCE

RELATED APPLICATIONS

This application is a Continuation-In-Part of application Ser. No. 29/079,887 filed Nov. 25, 1997 now U.S. Pat. No. D 403,979, in which was a Continuation-In-part of application Ser No. 08/712,812 filed Sep. 12, 1996 now U.S. Pat. No. 5,761,929, the disclosures of which are fully incorporated herein by reference. The drawings which are in this application are identical to drawings originally filed in Ser. No. 29/079,887. Further, no new matter has been added to the present application. Specifically, the reference letters A and B have been added to several of the figures identifying certain dimensions and their respective size relationships. Since these size relationships were inherent in the original drawings submitted with the prior patent applications, no new matter has been added thereby.

BACKGROUND OF INVENTION

The present invention is directed to improving the brilliance of gemstones, including diamond and colored precious and semi-precious stones. A new structure is provided which increases enhanced brilliance radiated from the precious stones by increasing reflecting surface area and the thickness of the stone.

Precious and semi-precious stones are cut to provide brilliance in an economical manner. This invention preferably is directed to round or oval stones in which a flat table normally is generally provided for the top surface. In some prior art structures, a barrel cut is provided which reduces the size of the flat table, but still has a large flat top area as well as unbroken parallel edges between rows of linear facet cuts extending from end to end of the stone. The present invention's structure provides a similar cut to the barrel cut while eliminating the large flat top area and otherwise providing structural differences which enhance the brilliance of the stone. The present invention not only improves brilliance of stones, but it improves the attractive and creative qualities of precious stone jewelry.

SUMMARY OF INVENTION

An object of this invention is to increase overall brilliance for colored stones.

Another object of this invention is to improve the design quality of precious stone jewelry by replacing the flat horizontal surface of the table of a stone with a new structure.

Still another object of this invention is to provide a new facet cut structure to increase brilliance.

Other objects, advantages, and features of the present invention will become apparent hereinafter.

The new invention improves the enhancement of brilliance of precious stones. The present invention replaces the flat horizontal surface of the table of a stone and increases the use of facet cuts to increase reflecting surface areas and overall thickness of the stone. Reflecting surface areas are responsible for reflecting light rays to radiate brilliance. Replacing the flat horizontal surface for the table enables more light rays to radiate from the top surface of the precious stone.

The structure of the new invention also provides greater brilliance because a thicker precious stone is realized. It is realized by having the upper portion of the stone continually step upwardly until reaching a center top edge. The height of the top of the stone to the girdle and to the culet is materially greater than that of the prior art. Such thickness provides greater color and brilliance of the new stone structure than found in the prior art. Providing a precious stone structure with more brilliance also greatly expands the artistic and attractive values of such precious stone jewelry.

This facet cut colored stone has a conical bottom and an upper surface with the upper surface cut to present a stepped facet cut terminating in a top center edge. In contrast to the prior art where the upper surface terminates in a flat table as seen in FIG. 2, the upper surface herein continuously is stepped upwardly to the top center edge. The thickness of the stone from the annular girdle to the top is increased which provides more color saturation and results in enhanced brilliance for the stone.

The same cut can be used for diamonds, but because of the loss factor, the carat weight loss may be too great to compensate for the increased brilliance of the stone.

DETAILED DESCRIPTION OF THE INVENTION

Figure 1:
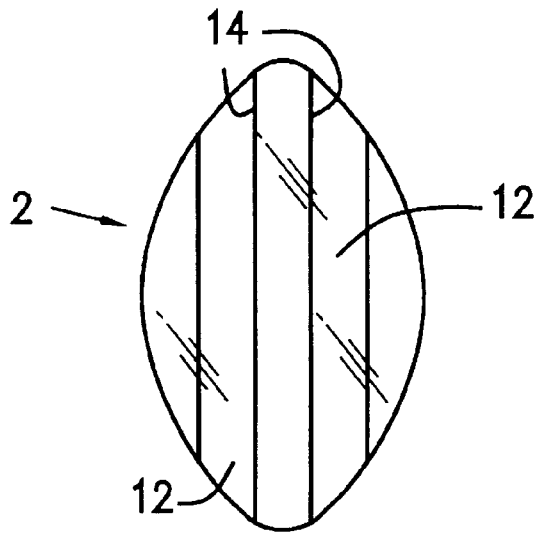
(PRIOR ART) FIG. 1
FIG. 1 is a top view of a prior art barrel cut precious stone.
Figure 2:
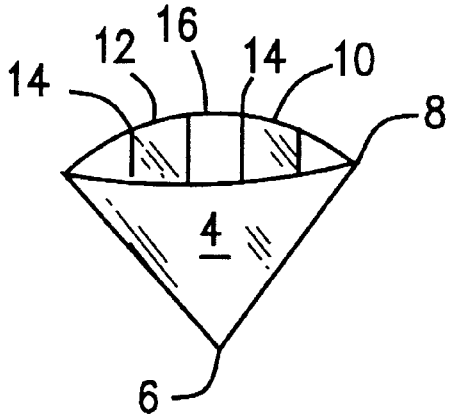
(PRIOR ART) FIG. 2
FIG. 2 is a perspective view of the prior art precious stone shown in FIG. 1.

FIGS. 1 and 2 show the prior art barrel cut precious stone 2, which contains a conical base 4 with a culet 6 on the bottom. It also contains a girdle 8 separating a rounded upper surface 10, which comprises a plurality of parallel facet cuts 12 separated by parallel edges 14 that run north to south. There is a center flat table 16 on top of the upper surface 10.

FIGS. 3 through 7 show various views of the present invention, which is a new structure for a cut precious stone that enhances overall brilliance. The illustrated stone 20 is oval but could be round or any other suitable shape. Looking at the stone from the top, the stone has a north end or side 40, a south end or side 50, an east end or side 60, and a west end or side 70. The stone 20 contains an upper rounded portion 22 terminating in an annular girdle 24 which separates the upper rounded portion 22 from a lower portion 26 which terminates in a lower culet 28. In the embodiment shown in FIGS. 3 through 7, the lower portion or base 26 is conical. In other embodiments, this lower portion or base also tapers to a point, but is not necessary a cone. For example, in the embodiment shown in FIGS. 15–18, the lower portion or base likewise tapers to a bottom point or culet, but is not perfectly conical.

The upper rounded portion 22 contains an upper approximately rounded convex surface made up of angled facet cuts 30 which produce a stepped buildup from the annular girdle 24 to a top edge 32 of the precious stone. The top edge 32 is preferably aligned with the culet 28 location and is preferably in the approximate center of the stone. This stepped buildup design provides a thicker amount of precious stone material. The amount of precious stone material is related to its ability to enhance brilliance and provide more color saturation. Therefore, more precious stone material enhances brilliance. As part of its design, the present invention, compared with the prior art, provides greater amount of precious stone material from the top edge 32 to the girdle 24 to achieve enhanced brilliance.

The facets 30 are bordered by facet boundaries 44 or 46. Upper midsection facet boundaries 44 are the facet boundaries between adjacent facets within upper midsection 42. In some of the embodiments of the present invention, as for example shown in FIGS. 3–7, facet boundaries 44 are parallel within the upper midsection of the stone 42. In other embodiments, as for example shown in FIGS. 9–13, the facet boundaries 44 converge toward a single point, although not necessarily meeting at that point within upper midsection 42. While converging toward a single point, however, they do not meet at that single point within the upper midsection.

Figure 10:
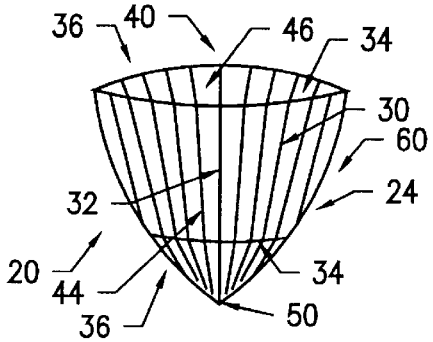
FIG. 10 is a top view of the second embodiment of the invention shown in FIGS. 8–9.
Figure 12:
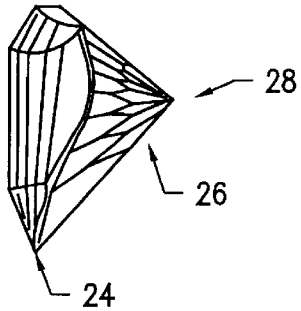
FIG. 12 is a right side view of the second embodiment of the invention shown in FIGS. 8–11 with the left side being a mirror image thereof.
Figure 11:
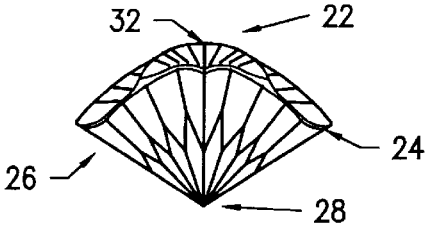
FIG. 11 is a front view of the second embodiment of the invention shown in FIGS. 8–10.
Figure 13:
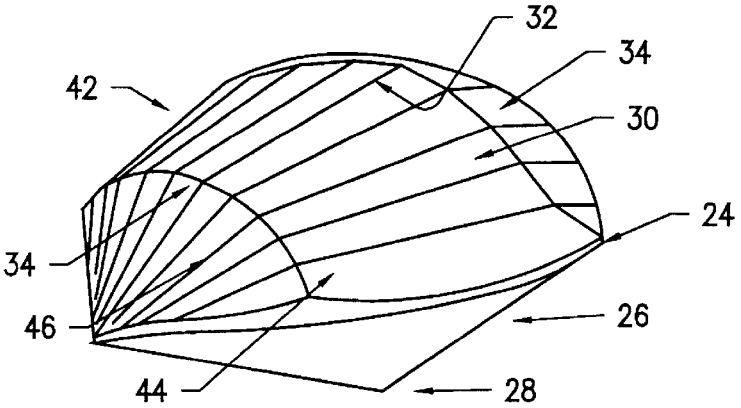
FIG. 13 is a perspective view of the second embodiment of the invention shown in FIGS. 8–12.
Figure 15:
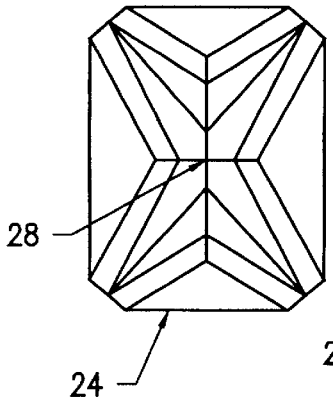
FIG. 15 is a bottom view of the third embodiment of the invention shown in FIG. 14.
Figure 24:
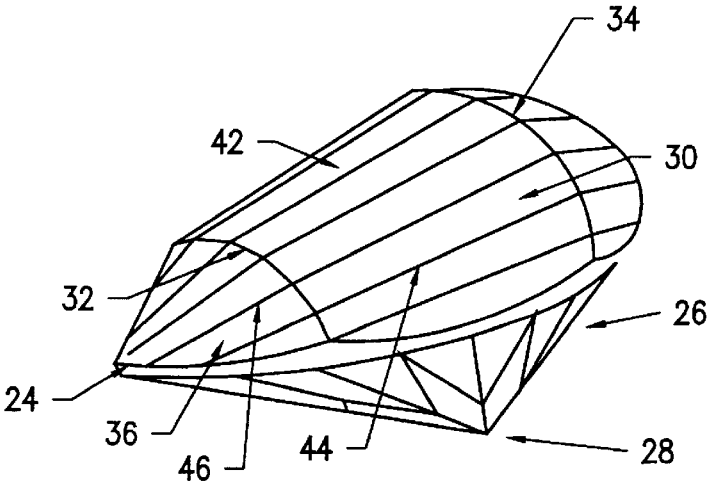
FIG. 24 is a perspective view of the fourth gem cut invention shown in FIGS. 19–23.
Figure 25:
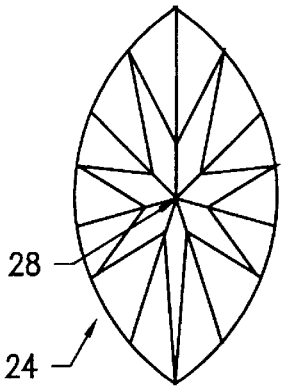
FIG. 25 is a bottom view of a fifth embodiment of the invention comprising a gem cut.

Secondary facet boundaries 46 are the facet boundaries between adjacent facets within sides or sloping sections 36. In some of the embodiments of the invention, as shown for example in FIG. 3, secondary facet boundaries 46 diverge as they extend from transverse boundary 34 to the annular girdle. In other embodiments of the invention, as shown for example in FIG. 24, the secondary facet boundaries begin to converge toward a point, or converge to and meet at a point, as they extend from the transverse boundary to the annular girdle. As shown in FIGS. 10 and 13, within a single embodiment the secondary facet boundaries can converge beyond one transverse boundary and can diverge beyond the other transverse boundary, as the secondary facet boundaries extend from the transverse boundary to the annular girdle 24.

The present invention's ratio of precious stone material from the top 32 of the precious stone to its culet 28 surpasses that of the prior art. Consequently, an increase in thickness in precious stone material leads to greater color saturation which in turn enhances brilliance as well.

Figure 3:
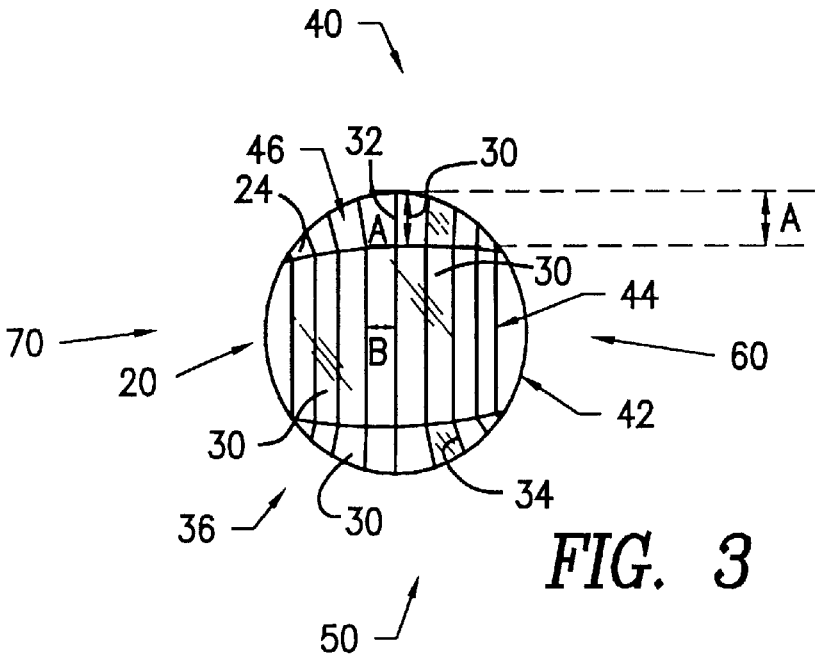
FIG. 3 is a top view of a precious stone with the new structure of the present step invention designed to provide enhanced brilliance.
Figure 4:
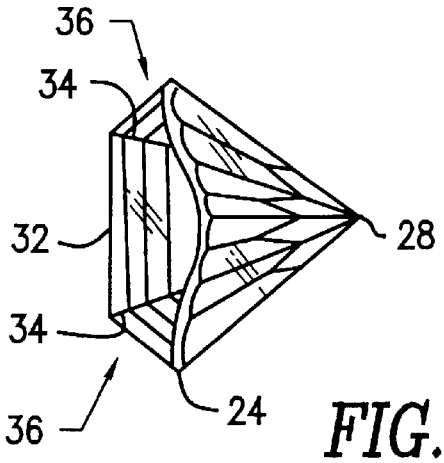
FIG. 4 is a side view of the precious stone shown in FIG. 3.
Figure 5:
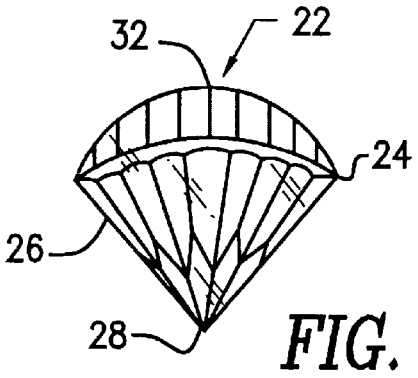
FIG. 5 is a front end view of the precious stone shown in FIGS. 3 and 4.
Figure 6:
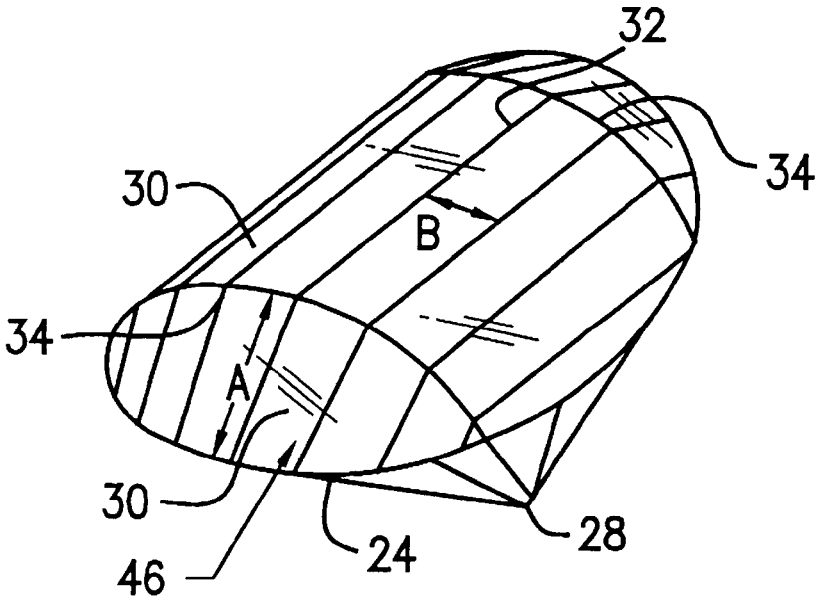
FIG. 6 is a perspective view of the precious stone shown in FIGS. 3, 4, and 5.
Figure 7:
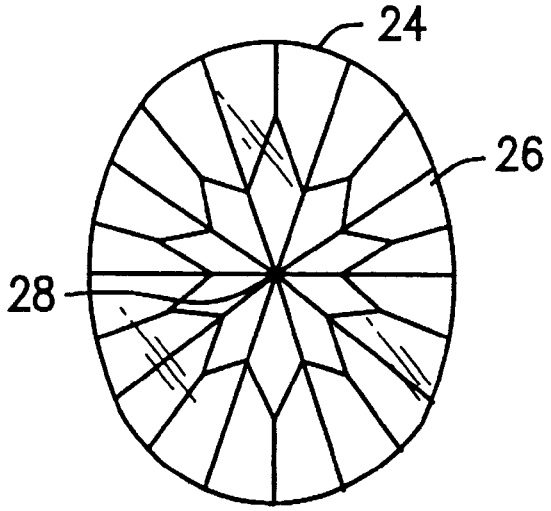
FIG. 7 is a bottom view of the precious stone shown in FIGS. 3, 4, 5, and 6.
Figure 9:
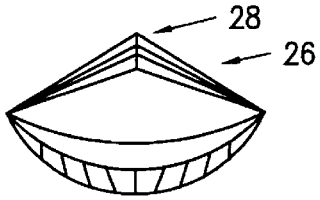
FIG. 9 is a back view of the second embodiment of the invention shown in FIG. 8.
Figure 8:
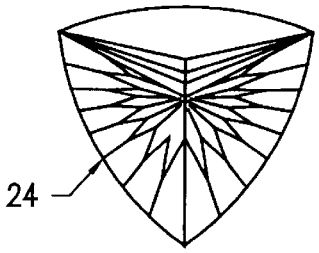
FIG. 8 is a bottom view of a second embodiment of the invention comprising a gem cut.

This invention also utilizes breaks or transverse boundaries 34 in the facet cuts to radiate more brilliance. Breaks or transverse boundaries 34 function like facet cuts 30 except that they are located on the sides or sloping sections 36 of the precious stone. In FIG. 3, transverse boundaries 34 extend from the east side of the stone 60 to the west side of the stone 70. Break or transverse boundary 34 serves as the border between sloping sections 36 and upper midsection 42. Upper midsection 42 serves as the middle area between transverse boundaries 34, while sloping sections 36 serve as the outer areas between the transverse boundaries 34 and the annular girdle 24. As stated previously, when the precious stone reduces the loss of entering light rays, these light rays are then reflected. Breaks 34 provide another outlet for these light rays to exit, which results in enhanced brilliance.

Figure 14:
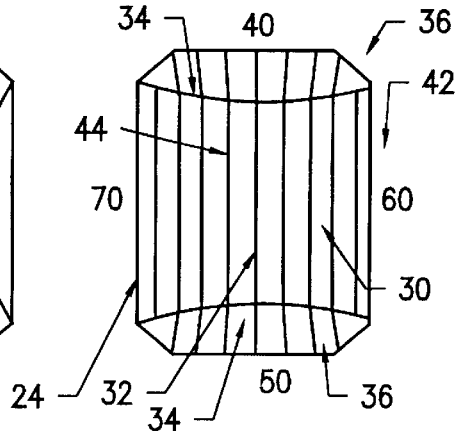
FIG. 14 is a top view of a third embodiment of the invention comprising a gem cut.
Figure 17:
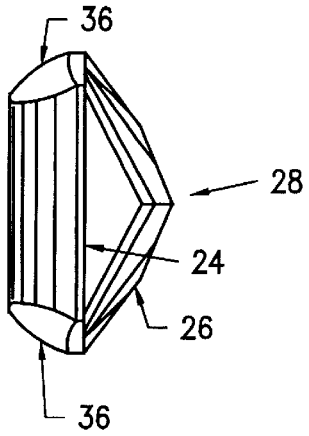
FIG. 17 is a right side view of the third embodiment of the invention shown in FIGS. 14–16 with the left side being a mirror image thereof.
Figure 16:
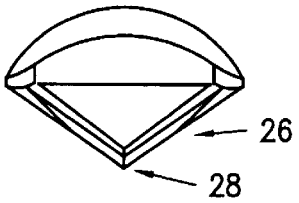
FIG. 16 is a front view of the third embodiment of the invention shown in FIGS. 14–15, with the back view being identical thereof.
Figure 18:
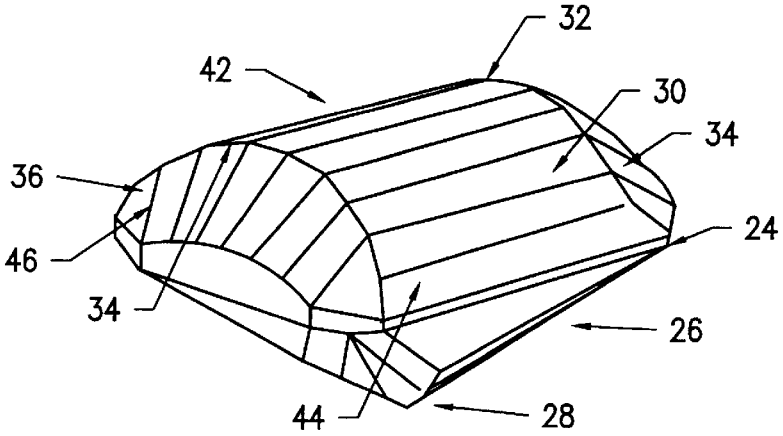
FIG. 18 is a perspective view of the third embodiment of the invention shown in FIGS. 14–17.
Figure 23:
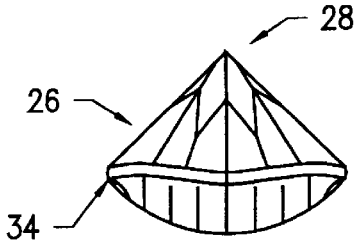
FIG. 23 is a back view of the fourth gem cut invention shown in FIGS. 19–22.
Figure 19:
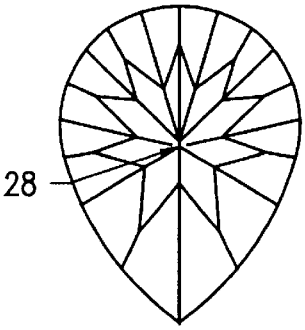
FIG. 19 is a bottom view of a fourth embodiment of the invention comprising a gem cut.
Figure 20:
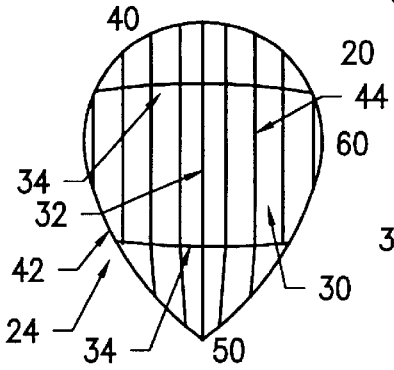
FIG. 20 is a top view of the fourth embodiment of the invention shown in FIG. 19.
Figure 21:
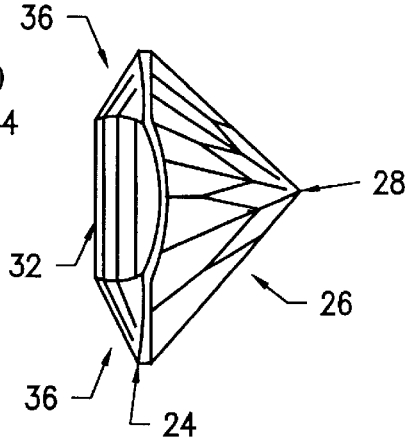
FIG. 21 is a right side view of the fourth embodiment of the invention shown in FIGS. 19–20 with the left side being a mirror image thereof.
Figure 22:
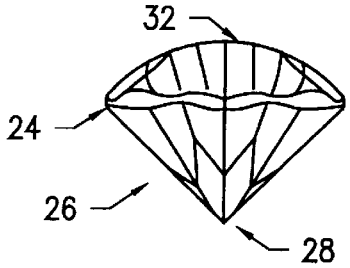
FIG. 22 is a front view of the fourth gem cut invention shown in FIGS. 19–21.
Figure 26:
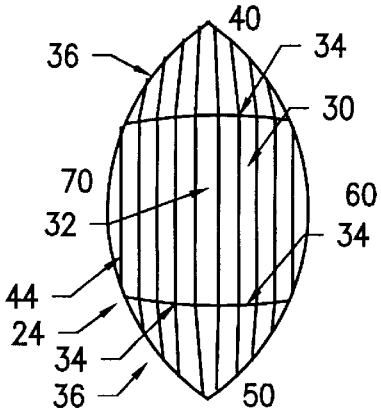
FIG. 26 is a top view of the fifth embodiment of the invention shown in FIG. 25.
Figure 27:
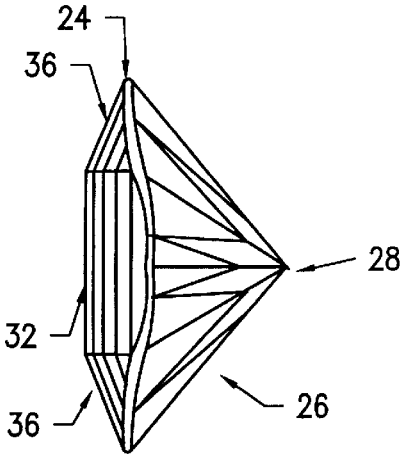
FIG. 27 is a right side view of the fifth embodiment of the invention shown in FIGS. 25–26 with the left side being a mirror image thereof.
Figure 28:
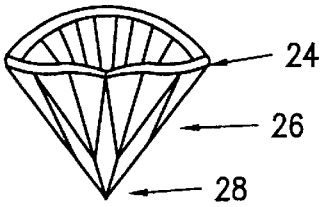
FIG. 28 is a front view of the fifth gem cut invention shown in FIGS. 25–27, with the back view being identical thereof.
Figure 29:
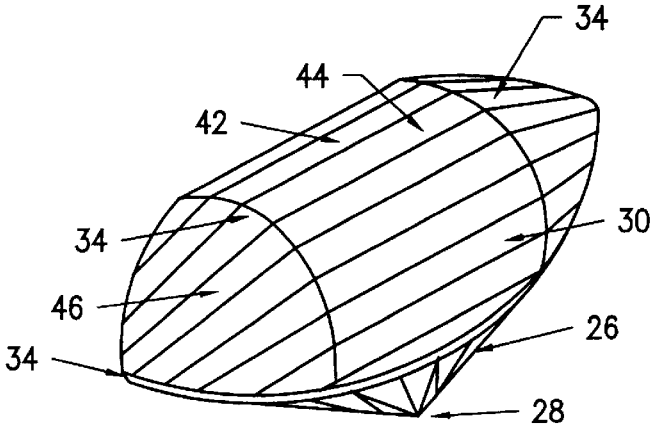
FIG. 29 is a perspective view of the fifth gem cut invention shown in FIGS. 25–28.
Figure 30:
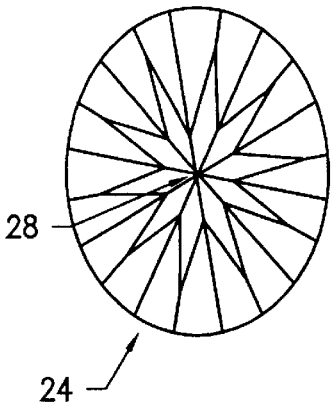
FIG. 30 is a bottom view of a sixth embodiment of the invention comprising a gem cut.
Figure 31:
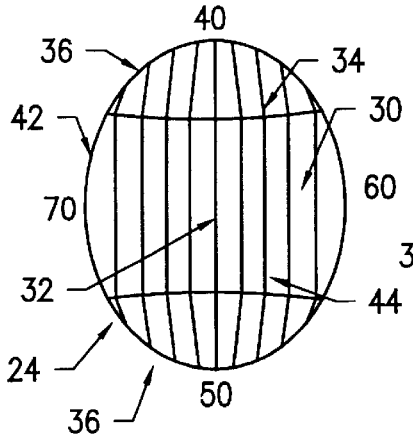
FIG. 31 is a top view of the sixth embodiment of the invention shown in FIG. 30.
Figure 33:
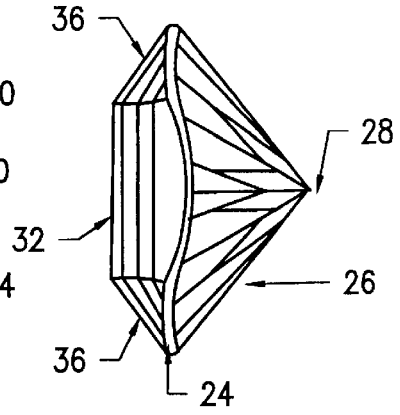
FIG. 33 is a right side view of the sixth embodiment of the invention shown in FIGS. 30–32 with the left side being a mirror image thereof.
Figure 32:
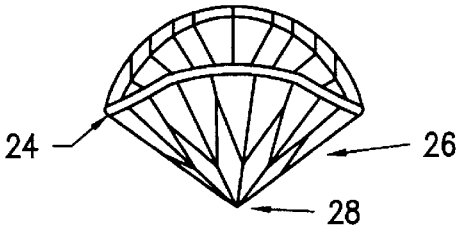
FIG. 32 is a front view of the sixth embodiment of the invention shown in FIGS. 30–31, with the back view being identical thereof.
Figure 34:
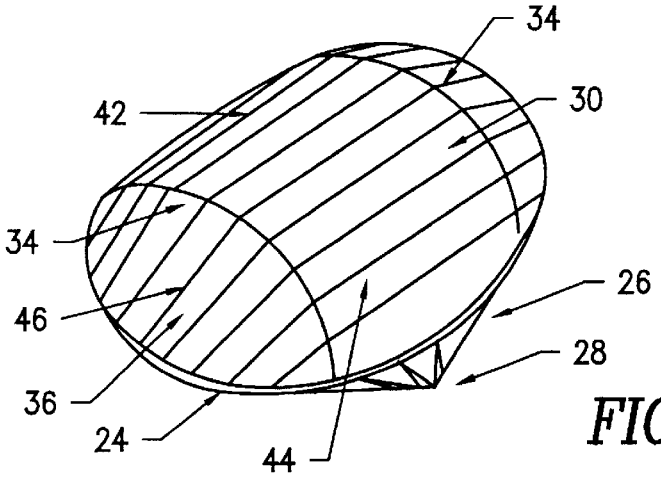
FIG. 34 is a perspective view of the sixth embodiment of the invention shown in FIGS. 30–33.

Additional embodiments of the invention are shown in FIGS. 9–34. FIGS. 9–13 illustrate a second embodiment of the invention, in which the gem is three-sided as viewed from the top, as shown in FIG. 10. FIGS. 15–18 illustrate a third embodiment of the invention in which the gem is rectangular in shape as viewed from the top, as shown in FIG. 14. FIGS. 19–24 illustrate a fourth embodiment of the invention in which the gem is teardrop-shaped as viewed from the top, as shown in FIG. 20. FIGS. 25–29 illustrate a fifth embodiment of the invention in which the gem is oval-shaped as viewed from the top, as shown in FIG. 26. FIGS. 30–34 illustrate a sixth embodiment of the invention in which the gem is also oval in shape as viewed from the top, as shown in FIG. 31.

In a further embodiment of the invention, as shown for example in FIGS. 3–7, the width of one or both of the sides or sloping sections 36 is, at its widest, at least as wide as or is wider than the facet cut width of the gemstone. Looking at the stone shown in FIG. 3, the sloping section 36 has a sloping section width ("A"), i.e. a width at its widest portion as measured from the transverse boundary to the annular girdle, which is wider than the facet cut width ("B") of one of the facets of the stone. The facet cut width ("B") is the width of one of the facets, i.e. the width between the two parallel boundaries of a facet.

In a preferred embodiment, the facet cut width is the same or substantially the same for all of the facets in the midsection. Thus, in a preferred embodiment having parallel boundaries, the facet cut width is the same or substantially the same for all of the facets. For those embodiments of the invention in which the facet cut width varies along the facet from one transverse boundary to the other (see e.g. FIGS. 9–13), the facet cut width is defined herein as the width at the midpoint between the transverse boundaries, with the minimum facet cut width being the minimum width of the facet cut (i.e at one end of the facet) and the maximum facet cut width being the maximum width of the facet cut (i.e. at the other end of the facet).

In further embodiments, one or more of the sloping sections or sides 36 are at least as as wide as or are wider than two facet cut widths. In further embodiments, the sides are at least as wide as or are wider than three or more facet cut widths. This dimensioning of the sloping sections or sides 36 can be applied to any of the embodiments of the present invention.

Having described this invention with regard to specific embodiments, it is to be understood that the description is not meant as a limitation since further modifications and variations may be apparent or may suggest themselves to those skilled in the art. It is intended that the present application cover all such modifications and variations as fall within the scope of the appended claims. Such variations can include, for example, the shape, color and/or material of the stones.

I claim:

1. A jewelry stone comprising a culet, a rounded base pavilion with faceted surfaces emanating from said culet, said rounded base pavilion terminating in a girdle forming an outer rounded surface of said stone, said stone comprising an upper rounded surface having adjacent cuts forming facets and having first boundaries and a plurality of transverse boundaries, said first boundaries being between said adjacent cuts with said first boundaries extending between said plurality of transverse boundaries, from a northeast side to an opposite southwest side of said stone, said plurality of transverse boundaries formed substantially opposite to each other and substantially transverse to said first boundaries, said plurality of transverse boundaries forming continuous lines from east to west sides of said stone, said transverse boundaries tapering downwardly and inwardly toward each other at said east and west sides of said stone, said upper rounded surface terminating in a center top edge aligned with said culet, said upper rounded surface formed of a plurality of faceted upwardly stepped segments said upper rounded surface extending symmetrically outwardly toward said girdle and intersecting said transverse boundaries, said stone further having downwardly sloping faceted surfaces symmetrically designed with relationship to the stone and extending from said transverse boundaries, respectively, to said girdle, said downwardly sloping faceted surfaces having boundaries therebetween forming sloping sections, wherein said boundaries between said sloping sections are colinear with respective ones of said first boundaries, the width between a said respective transverse boundary and said girdle of the widest of said sloping sections being greater than the widest distance between adjacent ones of said first boundaries.

2. The jewelry stone as set forth in claim 1 wherein said jewelry stone is oval.

3. The jewelry stone as set forth in claim 2 wherein said jewelry stone is a colored stone.

4. The jewelry stone as set forth in claim 1 wherein said jewelry stone is round.

5. The jewelry stone as set forth in claim 4 wherein said jewelry stone is a colored stone.

6. The jewelry stone as set forth in claim 1 wherein said jewelry stone is pear-shaped.

7. The jewelry stone as set forth in claim 6 wherein said jewelry stone is a colored stone.

8. The jewelry stone as set forth in claim 1 wherein said jewelry stone is a colored stone.

9. The jewelry stone as set forth in claim 1 wherein said rounded base pavillion is conical.

10. The jewelry stone as set forth in claim 1 wherein said upper rounded surface is convex.

11. The jewelry stone as set forth in claim 1 wherein said first boundaries are parallel with respect to one another.

12. The jewelry stone as set forth in claim 1 wherein said width of said widest of said sloping sections is at least twice the distance between adjacent ones of said first boundaires.

13. The jewelry stone as set forth in claim 12, wherein said jewelry stone is a colored stone.

14. The jewelry stone as set forth in claim 12, wherein said jewelry stone is round.

15. The jewelry stone as set forth in claim 14, wherein said jewelry stone is a colored stone.

16. The jewelry stone as set forth in claim 1, wherein said jewelry stone is marquise shaped.

17. The jewelry stone as set forth in claim 1, wherein said jewelry stone is rectangular shaped.

* * * * *